United States Patent [19]

Koul et al.

[11] Patent Number: 4,785,872

[45] Date of Patent: Nov. 22, 1988

[54] CASTING POWDER FOR USE IN BOTTOM POUR INGOT STEEL PRODUCTION AND METHOD FOR EMPLOYING SAME

[75] Inventors: Maharaj K. Koul, Pennington, N.J.; Richard Paul, Philadelphia, Pa.

[73] Assignee: Atlantic Metals Corporation, Philadelphia, Pa.

[21] Appl. No.: 102,297

[22] Filed: Sep. 25, 1987

Related U.S. Application Data

[63] Continuation of Ser. No. 896,067, Aug. 13, 1986, abandoned.

[51] Int. Cl.[4] ..... B22D 27/00

[52] U.S. Cl. ..... 164/56.1; 164/123

[58] Field of Search ..... 164/55.1, 56.1, 123

[56] References Cited

U.S. PATENT DOCUMENTS

| | | | |
|---|---|---|---|
| 3,308,514 | 3/1967 | Osborn | 164/123 |
| 3,323,869 | 6/1967 | Olstowski . | |
| 3,934,637 | 1/1976 | Potier | 164/56.1 |

FOREIGN PATENT DOCUMENTS

| | | | |
|---|---|---|---|
| 1473908 | 5/1977 | United Kingdom | 164/55.1 |
| 1487175 | 9/1977 | United Kingdom | 164/55.1 |

*Primary Examiner*—Kuang Y. Lin

*Attorney, Agent, or Firm*—David J. Johns

[57] ABSTRACT

A casting powder for use in ingot steel production through bottom pour process is provided. The powder combines the crucial properties of existing bottom pour fluxes and hot topping compounds into a single, easily dispensed mixture. The present invention provides a significant simplifying and savings over present methods while producing steel with fewer impurities.

7 Claims, No Drawings

CASTING POWDER FOR USE IN BOTTOM POUR INGOT STEEL PRODUCTION AND METHOD FOR EMPLOYING SAME

BACKGROUND OF THE INVENTION

This invention relates to mold powders employed in ingot steel production. More specifically, the present invention discloses a casting powder to be employed in bottom pour steel molds which has the unique ability to act as both a bottom pour flux and a hot topping compound.

The use of bottom pour process to produce ingot steel has enjoyed substantial recent success with millions of tons of steel each year. Produced with this process. In order for the process to work effectively, fluxes must be added on the surface of the molten steel as it begins to enter the mold. These fluxes are crucial both to prevent reoxidation through a complete covering of the rising steel and to insulate the steel and prevent premature solidification and skulling.

Presently two separate casting powders are applied in the production of each bottom poured ingot. First, a sealed bag of bottom pour flux is suspended in the mold approximately six to eighteen inches above the inlet for the molten steel. The bottom pour flux consists of chemical compounds which melt and spread rapidly across the surface of the molten steel. The molten slag coating the surface of the steel acts to create the correct menisus shape and prevents oxidation of steel surface. Additionally, the molten slag insulates the surface of the molten steel to slow solidification, and spreads a thin coat of homogenous glass between the mold and the molten steel to allow constant heat transfer and solidification and thus lessen thermally induced stresses and resultant cracking. Further the flux absorbs impurities such as deoxidation and reoxidation products and refractory particles. The bag containing the bottom pour flux burns upon the introduction of the molten steel into the mold thus automatically releasing the flux.

Although traditional bottom pour fluxes are crucial for efficient production of steel ingots they are not sufficient. In order to assure the surface quality of the ingots and maximizing yield by avoiding "pipe" (i.e. shrinkage and segregation), an additional layer of insulative material must be added immediately after the molten steel has filled the mold and entered "hot top" region. This material is referred to as "hot topping compound." Without the addition of hot topping compound, the molten steel would freeze in the hot top, thus not providing liquid steel to feed the shrinkage cavity (i.e. pipe) formed due to ingot solidification. The result would be to discard an entire segment of the steel ingot causing reduction in yield.

However, the application of hot topping compounds is not without its detractions. Adding hot topping compound is cumbersome, labor intensive, environmentally disruptive, and may contaminate the ingot steel.

Personnel, who could be better utilized elsewhere, must be stationed on the pouring platform above the molds to distribute the hot topping compound bags onto the molten steel. In addition to the cost of personnel, this process has two serious drawbacks. First, the pouring of the fine grained hot topping compound some two to ten feet onto the top of the powdery flux layer generates extensive clouds of environmentally harmful dust and smoke. Second, the addition of hot topping compound has been associated with a condition known as "core of debris." Core of debris occurs when the chilling effect of the hot topping compound causes steel to solidify around refractory inclusions which then sink into and contaminate the steel ingots.

In light of the foregoing, it is a primary object of the present invention to create one casting powder which provides the benefits of both a bottom pour flux and a hot topping compound.

It is a further object of the present invention to provide a one-step casting powder which is automatically dispensed through the bag suspension-burn method or a board presently used to dispense bottom pour fluxes.

It is an additional object of the present invention to provide a one-step casting powder which is economic to produce and use, entails little environmental risk, and does not contribute to ingot contamination.

SUMMARY OF THE INVENTION

The present invention is directed to casting powders for use in ingot steel production through bottom pour process. Instead of the bottom pour flux and the hot topping compound presently employed, the present invention substitutes a single casting powder which provides the benefits of both the prior products.

The present invention entails introducing a compound known as "expandable graphite" in place of a portion of the carbon component of a standard bottom pour flux. The resulting mixture provides all the insulative and protective benefits of standard bottom pour fluxes as well as the full insulative requirements of hot topping compounds.

The present invention is cleanly and automatically dispersed upon introduction of molten steel into the steel ingot molds. It eliminates the noxious by-products of hot topping compound and its potentially contaminating effect of "core of debris," and does not require the labor input demanded for application of hot topping compound.

DETAILED DESCRIPTION OF THE INVENTION

The present invention provides a mixture of chemical components which function as a unique casting powder for bottom pour ingot steel production. The present invention combines the crucial properties of both bottom pour fluxes and hot topping compounds into a single, easily dispensed, composition.

Bottom pour fluxes (or powders) presently employed are required to have specific qualities for covering and protecting molten steel rising in an ingot mold. These include: molten slag layer to completely coat the molten steel, to insulate, maintain a proper surface shape, protect against oxidation, and absorb deoxidation and reoxidation products; and an ability to form a thin layer of homogenous glass between the molten steel and the side walls of the mold so as to insulate, reduce thermally induced stresses and thus decrease cracking.

To this end, a composition of a traditional bottom pour flux may comprise the following:

| Constituent | Percentage (%) Range by Weight |
|---|---|
| Silica ($SiO_2$) | 30.0–35.0% |
| Aluminum Oxide ($Al_2O_3$) | 15.0–17.0 |
| Calcium Oxide (CaO) | 6.5–8.0 |
| Iron Oxide ($Fe_2O_3$) | 4.0–6.0 |
| Alkali Oxide | 5.5–8.0 |

-continued

| Constituent | Percentage (%) Range by Weight |
|---|---|
| Carbon (C) | 5.0–27.0 |

Hot topping compounds have only one primary purpose: to provide a thick insulative blanket on top of the molten steel to reduce the heat loss from the top to avoid "pipe." Pipe is a condition which occurs when there is no molten steel to feed the shrinkage cavity formed due to ingot solidification. Due to the expansion of the steel while molten, this discrepancy leaves the sides too high in respect to the core. Thus, without proper insulation, the center of the steel ingot will solidify in a sunken position or with severe imperfections—creating an entire segment of the ingot which must be excised and discarded.

To accomplish the necessary insulation, a wide variety of compositions have been utilized. Typical ranges are as follows:

| Constituent | Percentage (%) Range by Weight |
|---|---|
| Silica ($SiO_2$) | 5–30% |
| Aluminum Oxide ($Al_2O_3$) | 25–75 |
| Calcium Oxide (CaO) | 0–2 |
| Iron Oxide ($Fe_2O_3$) | 0–4 |
| Sodium Oxide ($Na_2O$) | 0–2 |
| Potassium Oxide ($K_2O$) | 0–3 |
| Carbon (C) | 0–15 |
| Magnesium Oxide (MgO) | 5–60 |
| Chloride (Cl) | 0–5 |
| Aluminum (Al) | 0–40 |
| Aluminum Nitride (AlN) | 0–4 |

Any attempt to combine the properties of bottom pour flux and hot topping compound is confronted with a paradox—how to provide a viscous coating material on the molten steel as it rises in the mold and also provide a highly insulative blanket in the upper (or "hot top") region of the steel ingot mold. The present invention accomplishes this through use of "expandable graphite."

Expandable graphite is produced through treatment of high grade natural crystalline graphite through oxidation or electrolysis by various oxidizing materials. It is commercially available in a number of grades from graphite suppliers.

When expandable graphite is heated rapidly it expands along the C-axis of the crystal to a magnitude of 40 to 300 times its original size.

By substituting expandable graphite for a portion of the carbon component usually employed in bottom pour fluxes, an entirely new and unique casting powder is provided. The composition of this casting powder is as follows:

| Constituent | Percentage (%) Range by Weight |
|---|---|
| Silica ($SiO_2$) | 30.0–35.0% |
| Aluminum Oxide ($Al_2O_3$) | 15.0–17.0 |
| Calcium Oxide (CaO) | 6.5–8.0 |
| Iron Oxide ($Fe_2O_3$) | 4.0–6.0 |
| Sodium or Potassium Oxide ($(Na,K)_2O$) | 5.5–8.0 |
| Total Carbon (C) | 5.0–27.0 |
| Expandable graphite | 4.0–12.0 |

In all other respects, the present invention is prepared in the same manner as standard bottom pour flux.

Expandable graphite has different expansion rates according to its quality. It is desired to use expandable graphite that expands 100 and 300 times by volume within the percentage weight range provided above. It is believed that, ideally a rate of expansion of 200 to 250 times its volume at a percentage weight of 6.0 to 8.0% should be employed.

Due to the affinity of the expandable graphite particles for one another, a highly expanded layer is produced which is as heat resistant and chemical resistant as standard graphite. The result is a thick insulative blanket which functions very well in place of hot topping compound.

However, the casting powder has a viscosity nearly identical to that of standard bottom pour flux (i.e. at 1500° C., bottom pour flux has a viscosity of approximately 50–200 poise, the present invention produces a flux with a viscosity of 50–200 poise). Moreover, under pressure the present invention produces a unique quality compression product having anistrophy. This results in a substance perfectly suitable to properly coat between the molten steel and the side walls of the ingot mold during pouring. Thus, the casting powder produced provides superior results as both a bottom pour flux and a hot topping compound.

The casting powder is dispersed in the same manner as standard bottom pour flux. It is placed in a combustible container or bag, such as paper bag with grommet reinforcements, and suspended six to eighteen inches above the bottom of the ingot mold. It can also be preformed into a board and placed at the bottom of the mold. The incoming molten steel consumes the container or dissolves the board causing the release of the powder. The powder then rapidly spreads across the surface of the incoming molten steel. This is a clean, automatic process which requires little human input and supervision.

The benefits of the present invention are realized, through the elimination of hot topping compound. Personnel are no longer required to be stationed above the molds to apply the insulative material. Atmospheric dust from the hot topping compound and "core of debris" are also eliminated. Additionally, no smoke products are produced whatsoever. Despite the somewhat higher cost of substituting expandable graphite for standard graphite, the elimination of hot topping compound and the considerable cost savings in application provide a considerable overall cost savings.

While particular embodiments of the present invention have been disclosed herein, it is not intended to limit the invention to such a disclosure and changes and modifications may be incorporated and embodied within the scope of the following claims.

What is claimed is:

1. A method for increased efficiency of protecting a steelmaker's mold and a steel ingot as bottom poured into the mold, including protecting against excessive piping of the steel which tends to occur when the molten steel cools too rapidly in the mold, comprising introducing into the mold a predetermined quantity of a casting powder, comprising chemical components combined to produce a bottom pour flux, and including an expandable graphite as at least 4.0% by weight of the composition of said casting powder, pouring molten steel into said mold and covered with said casting powder to cause a substantial portion of said casting powder to rise to the vicinity of the top of said mold, thinly coating the side walls of said mold as it rises, and expanding into a thick insulative blanket on top of the molten steel of a sufficient insulative quality of avoid a need for a hot topping compound, limiting the steel's rate of cooling and thereby minimizing the piping of the ingot;

wherein said insulative quality is achieved through use of an expandable graphite that expands to 100–300 times its volume and comprises 4.0 to 12.0% by weight of the composition of said casting powder.

2. A method in accordance with claim 1 wherein said insulative quality is achieved through use of and expandable graphite that expands to 200–250 times its volume and comprises 6.0 to 8.0% by weight of the composition of said casting powder.

3. A method in accordance with claim 1 wherein said casting powder is placed in a combustible container suspended at least six inches above the bottom of said mold.

4. A method in accordance with claim 3 wherein said combustible container is a combustible bag.

5. A method in accordance with claim 1 wherein said casting powder is formed into a board shape and placed at the bottom of said mold.

6. A casting powder employed in a mold for bottom pour steel ingot production, comprising a flux mixture of chemical components to produce a bottom pour flux which coats and protects the top and sides of molten steel as it is introduced into the mold, including an expandable graphite component as at least 4.0% by weight of the composition of said mixture, and which flux expands to form a thick insulative blanket on top of the molten steel of sufficient insulative quality to avoid need for a hot topping compound, limiting the steel's rate of cooling and thereby minimizing piping of the ingot;

wherein said insulative quality is achieved through use of an expandable graphite that expands to 100–300 times its volume and comprises 4.0 to 12.0% by weight of the composition of said mixture.

7. A casting powder is accordance with claim 1 wherein said insulative quality is achieved through use of an expandable graphite that expands to 200–250 times its volume and comprises 6.0 to 8.0% by weight of the composition of said mixture.

* * * * *

UNITED STATES PATENT AND TRADEMARK OFFICE

CERTIFICATE OF CORRECTION

PATENT NO. : 4,785,872

DATED : November 22, 1988

INVENTOR(S) : Maharaj K. Koul and Richard Paul

It is certified that error appears in the above-identified patent and that said Letters Patent is hereby corrected as shown below:

Column 1, line 15: "of tons of steel each year. Produced with this process." should read --of tons of steel each year produced with this process.--

Column 5, line 5, Change "of" to --to--

Column 5, line 16, Change "and" to --an--

Signed and Sealed this

Fourth Day of April, 1989

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,785,872

DATED : November 22, 1988

INVENTOR(S) : Maharaj K. Koul and Richard Paul

It is certified that error appears in the above-identified patent and that said Letters Patent is hereby corrected as shown below:

Col. 6, line 22: "l" should be --6--

Signed and Sealed this

Nineteenth Day of September, 1989

*Attest:*

DONALD J. QUIGG

*Attesting Officer*

*Commissioner of Patents and Trademarks*